United States Patent [19]

Perdue

[11] Patent Number: 4,592,833

[45] Date of Patent: Jun. 3, 1986

[54] PORTABLE SLUICE BOX

[76] Inventor: Vernon Perdue, 1244 Shaner La., Ferndale, Wash. 98248

[21] Appl. No.: 570,781

[22] Filed: Jan. 16, 1984

[51] Int. Cl.[4] ..... B03B 5/54

[52] U.S. Cl. ..... 209/44; 209/458; 209/500; 209/507

[58] Field of Search ..... 209/506, 507, 485, 500, 209/508, 458, 460, 483, 502, 44, 13, 14

[56] References Cited

U.S. PATENT DOCUMENTS

| | | | |
|---|---|---|---|
| 263,131 | 8/1882 | Edison | 209/506 |
| 928,870 | 7/1909 | LaPoint | 209/44 |
| 967,745 | 8/1910 | Erickson | 209/485 |
| 1,123,188 | 12/1914 | Green | 209/485 |
| 1,286,185 | 11/1918 | Mackie | 209/458 |
| 3,799,415 | 3/1974 | Tidd | 209/506 |
| 3,950,246 | 4/1976 | Klefisch | 209/500 |

*Primary Examiner*—Frank W. Lutter
*Assistant Examiner*—William Bond
*Attorney, Agent, or Firm*—Hughes & Cassidy

[57] ABSTRACT

A portable sluice box for classification of mineral particulate from detritus or placer deposits containing the same is comprised of an infeed table including upstanding sidewalls and a bottom wall for receiving and confining a charge of mineral-containing deposits for fluid compelled movement along a path lying in a material handling plane generally coincident with the bottom wall of the table; a classification table member, including upstanding sidewalls and a foraminous separation plate having downwardly depending, opposed marginal skirts for proximal engagement with the sidewalls of the separation table interiorly thereof, the separation plate also lying within the material handling plane; a plurality of riffles disposed transversely in a laterally and longitudinally extending spaced array between the skirts, defining a series of upper flow channels intermediate the separation plate and the top edge of the riffles and a lower, mat channel intermediate the bottom wall of the classification table and the bottom edges of the riffles in order to receive a mat; and an inlet channel at the juncture of the infeed table and the classification table for admitting water along a flow path through the flow channels from a location beneath the material handling plane.

16 Claims, 5 Drawing Figures

PORTABLE SLUICE BOX

BACKGROUND OF THE INVENTION

1. Field of the Invention

The present invention relates, generally, to mineral classification systems and, more particularly, to sluice boxes for wet placer mining. Further along these same lines, the sluice box of the present invention is particularly adapted for portable mobility in order that the same may be transported with relative ease to remote locations for wet placer mining of mineral-containing detrital material or placer ground.

2. Description of the Background Art

Wet placer mining is of course historically well known. It has been employed, literally for centuries, in the classification or separation of minerals from detritus, both alluvial and glacial, the classification being conducted on the basis of density separation. Conventionally, a sluice box is utilized for initial concentration of these mineral-containing materials by separation of coarser rock and lighter sand constituents. Routinely, the concentrated deposits then undergo further classification; e.g., they are "panned" to obtain valuable minerals. Gold, platinum, and like elements have been mined in this way for quite some time.

A wide range of designs for sluice boxes useful in wet placer mining has been proposed over the years. The usual design includes a trough or the like for receiving a charge of placer earth which is moved along a path under the influence of water. Sometimes the trough includes a separating or classifying table or plate which allows smaller pieces of rock, sand, along with the minerals, to fall to a lower lever while moving the larger rocks and similar constituents along the materials path. It is also sometimes helpful to incorporate transversely spaced riffles which provide flow impediments to the finer materials passing through the separation plate; allowing sand and similarly less dense material to travel somewhat more freely through the sluice than the heavier mineral particulate which tends to be trapped along the upstream edges of these elements. It is also sometimes advantageous to utilize a coarse mat which lies beneath the riffles to trap the minerals; which mat may then be removed with the mineral particulate intact for transferring the concentrated deposit to a secondary recovery device. A customary secondary recovery technique is hand panning, whereupon the mineral elements may be recovered.

The patent art presents an interesting patchwork of sluice boxes. Ranging from U.S. Pat. No. 516 (issued Apr. 23, 1831) which disclosed a so-called ore washer having a perforate classification table to U.S. Pat. No. 4,199,441 which concerns a high volume sluice box having multiple separation stages, the art has evolved substantially. Riffle-like members have been incorporated within inclined troughs, provided by folds in a sluice blanket; the same component thereby functioning for two different elements as disclosed in U.S. Pat. No. 73,160. U.S. Pat. Nos. 1,588,102 and 1,752,169 are noteworthy for disclosure of mineral concentrators or separators which include wire screens and perforated metal components for gravity separation of the constituents constituting a charge of mineral-bearing material; optionally including a layer of burlap or Brussels carpet to trap the finer and denser minerals. Along these latter lines, cf., e.g., U.S. Pat. Nos. 157,192 and 386,030. Rather unique separation plate constructions are the subject of U.S. Pat. No. 1,725,765, where a metal sheet is pierced in a desired pattern and portions thereof bent downwardly in the form of tabs or "lips" which cooperate with riffles in the device.

Although the art is conceptually well developed, modern needs and interests are not well accommodated by the old approaches. For several reasons, wet placer mining is most efficiently conducted in backcountry. On the one hand, more accessible sources of valuable detritus have been mined extensively and most have played out. On the other hand, many individuals relish the opportunity to engage in this type of activity more in the nature of a hobby to be coordinated with other outdoor enjoyments. In any of these events, however, the sluice box necessary for placer mining in this fashion must be transported to remote regions; entailing the need to carry the device over many miles and usually through harsh terrain. Sluice boxes known in the art are simply not adapted to those needs. Most sluice boxes tend to be large and unwieldy. They are much too heavy and large to be carried, let alone conveniently. Simply reducing size in order to reduce thereby the problems attendant lack of portable mobility is not an efficient answer; that ad hoc approach usually results in a device totally inefficient for its intended purpose of mineral classification.

Accordingly, the need exits to provide an improved sluice box which possesses portable mobility, allowing it to be transported with relative ease to remote regions, but without sacrificing separatory efficiency. The present invention responds to such needs.

SUMMARY OF THE INVENTION

The present invention advantageously provides an improved sluice box structure, one having portable mobility without the sacrifice of separation efficiency. The sluice box of the present invention is desirably collapsible to small size allowing it to be carried very conveniently to remote regions; for example, the present sluice box may be easily secured on a hiker's backpack. The present sluice box may be easily manufactured from lightweight metals or plastics for weight savings without loss of structural integrity, contributing further to its desirability in use.

The foregoing, and other advantages of the present invention are realized in one aspect thereof by a portable sluice box for classification of mineral particulate from detritus or placer ground containing the same, comprising infeed table means, including upstanding sidewalls and a bottom wall for receiving and confining a charge of mineral-containing detritus for fluid compelled movement along a path lying in a material handling plane generally coincident with the bottom wall of the table means; classification table means secured to the infeed table means, including upstanding sidewalls and a bottom wall, having a foraminous separation plate with transversely opposed marginal skirts disposed in proximal engagement with the sidewalls of the classification table and a top face effectively lying in the plane of material flow established in the infeed table and spaced above the bottom wall of the classification table for passing and thereby separating detrital particulate including mineral particulate having a predetermined maximum aspect from the charge; riffle means disposed transversely in a laterally and longitudinally spaced array across the plate bridging the skirts and defining (i) an upper flow channel intermediate the riffles and the top plate through which water and particulate may pass along a secondary flow path and (ii) a lower mat channel intermediate the riffles and the bottom wall of the classification table means for receiving a mat; and, inlet channel means at the juncture of the infeed and classification table means disposed beneath the bottom wall of the infeed table means and above the bottom wall of the classification table means for admitting water directly to the secondary flow path. Portable mobility is provided in accordance with a further aspect of the present invention, wherein the table means are secured together at a pivotal juncture allowing the two to fold with the respective sidewalls in a somewhat nested relationship. Convenience is improved upon in a related manner by securing the foraminous separation plate within the classification table means at a pivotal juncture as well, allowing the same to be moved to expose a mat disposed beneath that member. Preferably, the box includes handles which serve several functions; allowing the device to be carried conveniently, providing a convenient place to secure the sluice box to, e.g., a backpack and also providing a convenient place to tether or otherwise restrain the box when deployed within a stream.

Other advantages of the present invention, and a fuller appreciation of its construction and mode of operation, will be gained upon an examination of the following detailed description, taken in conjunction with the figures of drawing, wherein:

DETAILED DESCRIPTION OF THE PRESENT INVENTION

The present invention relates, generally, to mineral classification systems and, more particularly, to sluice boxes for wet placer mining. Further along these sames lines, the sluice box of the present invention is particularly configured to possess and provide portable mobility in order that it may be transported with relative ease to remote locations for wet placer mining of detrital material or similar placer ground. In this regard, the term "detritus" or "detrital" material is meant to connote either alluvial or glacial deposits containing valuable mineral constituents having a density greater than the remaining components, thus allowing for gravity separation; among which elements may be mentioned, gold, platinum, and the like. Those terms will be used in their broadest sense(s) herein to include, and interchangeably with, the terms "placer" or "placer ground (deposit)"; therefore contemplating deposits, alluvial or glacial, of gravel or sand containing heavy ore minerals, as gold, platinum, etc., which have been eroded from their original bedrock and concentrated as small particles that can be washed out of the valueless constituents. Accordingly, the present invention will now be described with reference to certain preferred embodiments within the aforementioned contexts; albeit, those skilled in the art will realize that such a description is meant to be exemplary and not limitative.

Figure 3:
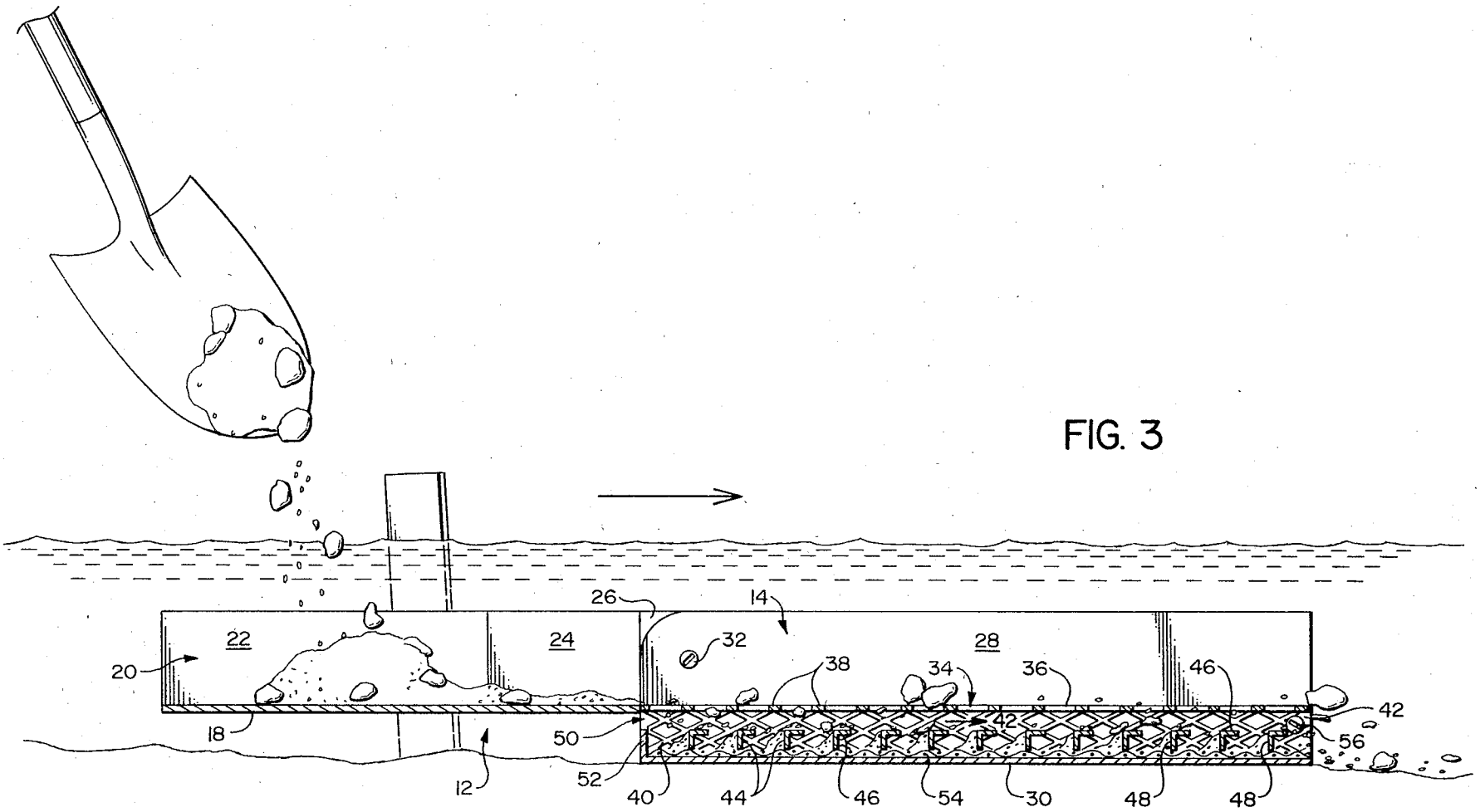
FIG. 3 is a side elevation view of the sluice box of FIG. 2, here showing the same disposed within a stream and receiving a charge of mineral-containing detritus for concentration and ultimately recovery of the valuable mineral constituents thereof.

Turning to the figures of drawing, in each of which like parts are identified with like reference numerals, a portable sluice box in accordance with the present invention, designated generally as 10, is shown in this exemplary embodiment to be comprised of an infeed table means designated generally as 12 and a classification table means designated generally as 14. Infeed table means 12 is itself constituted of upstanding sidewall members 16 and a bottom wall 18. In this particular configuration, the bottom wall 18 is of a generally trapezoidal shape with the sidewall 16 associated at the longitudinal periphery thereof. Thus, a tapering throat-like open channel designated generally as 20 (best viewed in FIG. 3) is established, merging to the classification table means 14. This throat 20 is bounded by opposed longitudinal sidewalls 22 and tapering sidewalls 24; the juncture between infeed and classification table means being facilitated by sidewall extensions 26. The classification table means has a generally similar configuration, in the sense that it is comprised peripherally by upstanding sidewalls 28 and a bottom wall 30. The overall structure of sluice box 10 is collapsible for the purpose of portable mobility as summarized briefly above; this aspect being fosterd by pivotal juncture means 32. In this instance, the pivots are comprised simply of threaded fixture members disposed through mating apertures in the sidewall extensions 26 of infeed table 12 and the forward ends of the sidewalls 28 comprising the classification table 14. Depending on the materials and mode of construction for the sluice box 10, considered brielfy below, other types of pivotal arrangements might be adapted to good advantages for these purposes.

The classification table 14 includes classification plate means designated generally as 34. The classification plate means 34 functions, inter alia, to provide a continuous material handling zone or path generally along the path established by the bottom wall of infeed table means 12 and a lower, secondary flow zone or path beneath it; all as best envisioned with reference to FIG. 3. More specifically, the placer ground or detritus which constitutes the charge deposited within the channel 20 on the bottom wall 18 of the infeed table is comprised usually of rocks, pebbles and fines, intermixed in most cases with sand, clay, various types of aggregate, and the denser minerals sought to be separated therefrom. The charge is distributed over the classification plate means 34 both by the operator of the sluice box and under the influence of, e.g., a moving stream; thus, at least in part the charge is initially fluid-compelled along its path. The classification plate means is designed to present a continuous path for the larger material in the nature of rocks and the like having a dimensional aspect in excess of some predetermined size, while allowing the finer material such as sand along with mineral particulate to drop into the lower flow zone. Accordingly, the classification plate means is preferably comprised of a foraminous separation plate 36 having an array of apertures or the like 38 formed therein. The dimensioning of apertures 38 dictates the first level of classification discrimination, insofar as large objects such as stones with a dimensional aspect in excess of the dimensions of the foramens constituting the plate 36 will pass along the separation plane it provides as a continuous extension of that defined by the bottom wall 18. In this most preferred embodiment, the classification plate means 34 is comprised of a sheet of expanded metal formed into a generally U-shaped configuration to define the top, separation plate 36 having apertures 38, together with first and second marginal skirts 40 along the longitudinal side edges thereof. The expanded metal sheet is sized such that the plate 34 is captured in proximal, preferably frictional, engagement interiorly of the sidewalls 28 in order to maintain positive cooperation between it and the classification table member as well as the infeed table. Thus, a secondary flow channel designated generally as 42 is defined beneath the separation plate 36 intermediate that element and the bottom wall 30 of the classification table means. The upper channel 20 provides a path for larger aspect constituents of the detritus charge, while the lower flow channel 42 likewise serves as a path, but here for the smaller aspect constituents of that charge.

Figure 4:
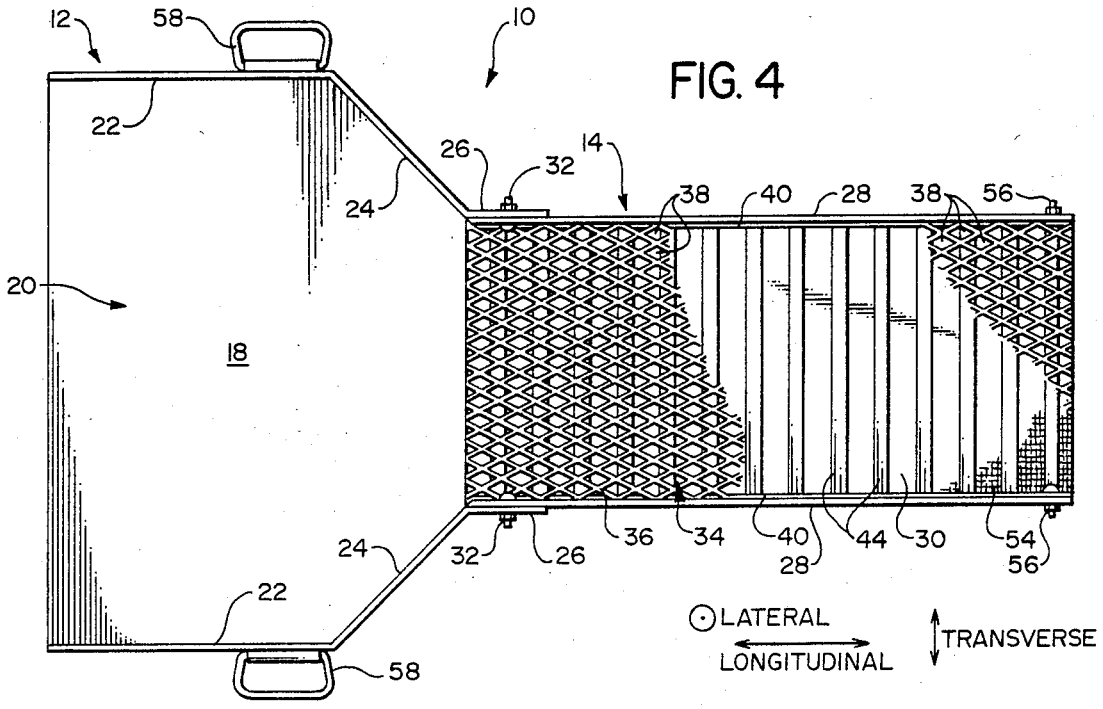
FIG. 4 is a top plan view of the sluice box of FIG. 2.

The progression of material from the detritus through the flow channel 42 is most preferably somewhat impeded in order take full advantage of the density differences between mineral constituents and the valueless components of the placer ground being mined. This flow interruption is provided in part by a plurality of riffle means designated generally as 44 and best viewed in FIGS. 3 and 4. The riffle means 44 are disposed transversely across the flow channel 42 in a laterally and longitudinally spaced array bridging the skirts 40. More particularly, each riffle member 40 extends transversely from one skirt to the other, preferably secured thereto at either end thereof (e.g., by welding) to provide added rigidity to the classification plate means, including these downwardly depending skirts. Each riffle is spaced laterally, beneath the lower surface of the separation plate 36 to yield the flow channel 42 between the riffle member and that plate. It has been determined that the most preferred conformation for this particular purpose is a generally right angled shaped riffle (such as a conventional angle structual member) as best viewed in FIG. 3. Each of the riffles therefore includes a top face extending longitudinally in the direction of the channel 42 and a downwardly depending leg 48 projecting laterally on the upstream side thereof. In this manner, fines collect on the upstream face of leg 48 in pockets lying thereagainst. These fines are washed by flowing water through the sluice which motivates the lighter sand material from riffle to riffle and ultimately out the extreme distal end of the channel to the stream, leaving the denser mineral deposits which are not impelled along that path or are less likely to be impelled along that path due to their greater densities.

All other things being equal, the smaller size of the sluice box 10 of the present invention would have a tendency to contribute to upstream plugging of the riffles after the sluice had been worked for quite some time. This plugging would be anticipated, for example, by the collection of sand and gravel which could not be efficiently washed through the device because of the lower volume capacity of wash water which can be accommodated due to restricted physical dimensions. Thus, were simple conventional designs to be adopted but merely reduced in size, the device would require relatively frequent attention by the operator to clear the riffles in order to keep the efficiency of separation at some optimal level. The present sluice box minimizes that teduim and collateral loss of either time or efficiency by means of an inlet channel 50 which admits water directly to the flow channel 42 at its extreme upstream or proximal end; the channel 50 being defined within an upstanding front face or wall 52 of the classification table means 14, terminating suitably below the material handling plane as best viewed in FIG. 3. Thus, this inlet channel 50 at the juncture of the two table members 12 and 14, beneath the bottom wall 18 of the infeed table and the separation plate 36 but above the bottom wall 30, admits water flow directly to and thence through the device, thus creating greater turbidity and agitation (i.e., turbulence) of fines than would be the case were wash water required to follow only a path above the material handling plane and then migrate through the plate. This dual flow path has been determined to improve so substantially the operation of the sluice box 10 that continuous operation for many hours is anticipated under most mining conditions.

Retention efficiency, in terms of the mineral constituents to be segregated, is further improved by including a placer mat 54 of generally conventional composition. Thus, the mat 54 might be formed from burlap, a rug remnant, or similar fabric-like material having a map or texture designed to trap and thereby retain mineral particulate. The placer mat 54 is confined within a mat channel provided below the riffles 44 by transversely spacing the same somewhat upwardly of the bottom wall 30 of the classification table means. Normally, the mat 54 will thereby be sandwiched transversely across the separation zone of the classification plate of the table. When it is desired to remove that mat for purposes of retrieving concentrated detrital to subject it to further separation, the classification plate means of the preferred embodiment—a formed piece of expanded metal—may be simply lifted due to the frictional engagement between it and the sidewalls. For the sake of convenience, the classification plate 34 may be pivotally secured to the sidewalls 28 by pivot members 56 to facilitate that operation.

Figure 1:
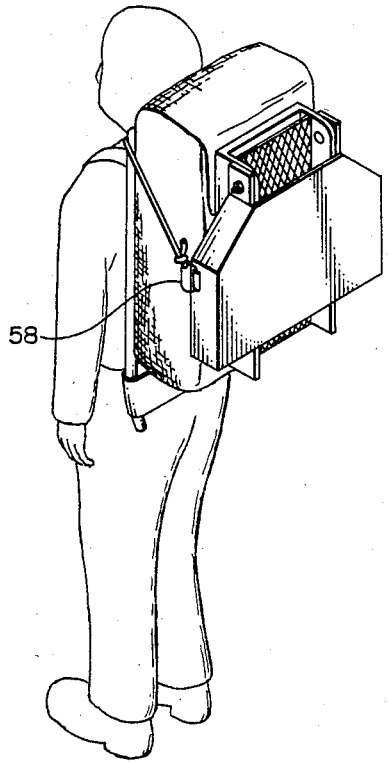
FIG. 1 is a perspective view illustrating a portable sluice box in accordance with the present invention borne upon a hiker's backpack, provided here to convey both the notion of portable mobility and some reference for consideration of its relatively small size and compact storage/handling configuration.
Figure 2:
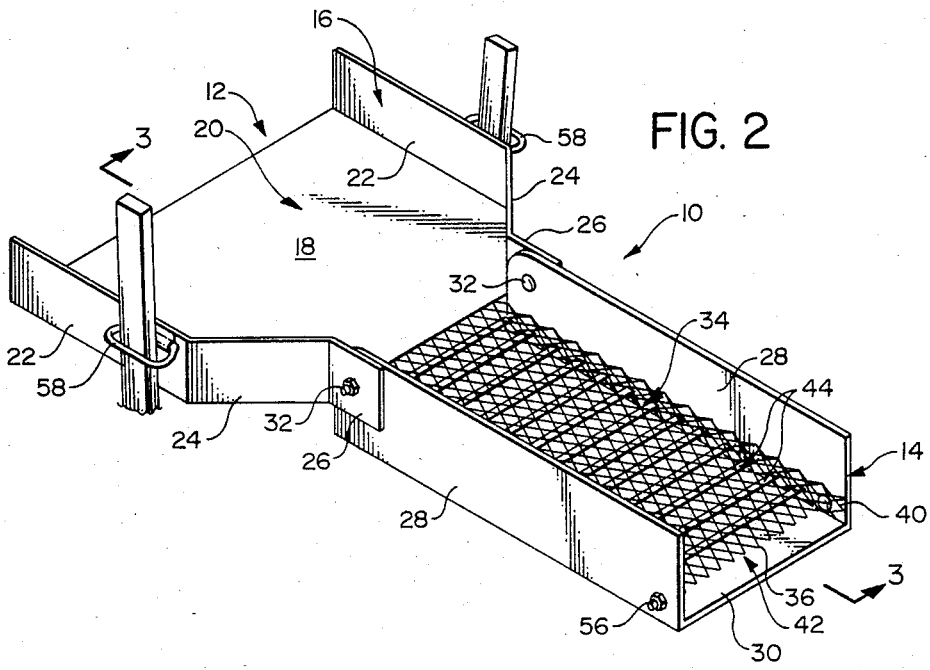
FIG. 2 is a perspective view, showing only the portable sluice box of the present invention in a semi-environmental context, with stakes or the like employed to restrain the same in place.
Figure 5:
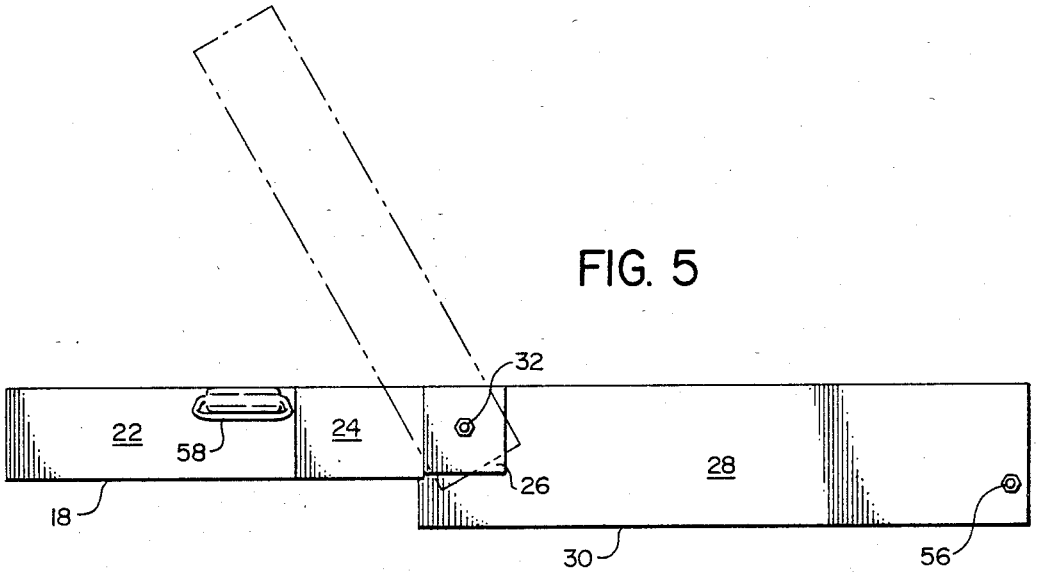
FIG. 5 is a side elevation view of the sluice box of FIG. 2, here showing in phantom lines the pivotal disposition of its components in order to achieve the storage/handling configuration illustrated in FIG. 1.

Optionally but preferably the sluice box 10 includes a pair of handles 58 or like elements which are added to serve many different functions. In the preferred embodiment shown, the handles 58 are attached to the sidewalls 22 of the infeed table, proximate their juncture with the tapered walls 24. With the most preferred sizing of components, the sluice box 10 may be folded conveniently into the configuration shown in FIG. 1 as generally envisioned with further reference to FIG. 5; the two major structural components pivoting one about the other at the fixtures 32. When so folded, with the bottom wall 18 now resting atop the edges of sidewalls 28, the device may very simply be carried in one hand of the other by means of these handles 58. Alternatively and/or additionally, as shown in FIG. 1, the handles serve as a very convenient place for tethering the sluice box to a hiker's backpack. Then too, the small size of the sluice box will allow the same (under many circumstances) to float or have a tendency to float or otherwise move under the influence of the current in a stream. To prevent that, the handles 58 serve the further optional function of providing a convenient way to restrain the device in use, as shown for example by the stakes disposed through the open handles in FIGS. 2 and 3.

The sluice box 10 of the present invention is as easily fabricated as it is to use, the method of production also being as efficient as its separatory ability. All of the components may be formed from lightweight polymers having good impact strength to withstand the weight of the charge to the sluice. The components such as the classification plate may conveniently be injection molded or hot pierced, while the linear/planar elements can be formed into the overall configuration in any convenient way including simple joining by autogenous techniques in conventional use (e.g., ultrasonic welding). The considerably lighter weight afforded by plastic construction may under some circumstances imply the need to include a shim or stabilizing member at the extreme proximal end of the infeed table 12 to prevent it from rocking during use; otherwise, the overall construction is the same as shown in the figures. It is equally well conceivable to fabricate the device from light metals, such as aluminum. In that case, the elements can be bent, welded, or secured by normal fixture members at the option of the fabricator. Metal construction offers somewhat greater impact strength over a wider temperature at a slight weight penalty. In any of these events, however, the overall construction is compact allowing the device to be transported to very remote regions with relative ease, and there be deployed for the efficient separation of valuable minerals from detritus or placer ground.

While the invention has now been described with reference to certain preferred embodiments and suggested modes of fabrication, those skilled in the art will appreciate that various substitutions, modifications, omissions, and changes may be made without departing from the spirit thereof. For example, the most preferred classification plate, constructed from conventional expanded metal, might equally well be a plate pierced in a different desirable pattern, including a gradient in aperture configuration and/or dimensions should that be necessary or desirable depending upon the characteristics and quality of the placer ground or detritus being minded. Accordingly, those skilled in the art will appreciate further that the foregoing description is meant to be exemplary only and not limitative respecting the scope of the claims granted herein.

What is claimed is:

1. A portable sluice box structure adapted to be carried conveniently to an operating location and to be positioned in a stream of water for classification of mineral particulate from detritus containing the same, said sluice box having a front upstream end, a rear downstream end, a longitudinal axis extending from said front end to said rear end, and a transverse axis, said box comprising:

a. infeed table means, including upstanding first sidewalls and a first bottom wall at a first level for receiving and confining a charge of mineral-containing detritus for fluid compelled movement along a path lying in a material handling plane generally coincident with said first bottom wall of said table means, said infeed table means having an open upstream end to receive an inflow of the stream of water over said first bottom wall and an open downstream end to discharge the charge under the influence of the moving stream;

b. a classification table means arranged to have, relative to said infeed table means, an operating position where said classification table means is secured to said infeed table means so as to extend therefrom in a downstream direction, said classification table means comprising two upstanding second sidewalls and a second bottom wall positioned at a second level below said first level, said classification table means having a foraminous separation plate which, with the classification table means in said operating position, is at a level above said second bottom wall but no higher than said first level and extending between said two second sidewalls, said classification table means having a substantially open upstream end which, with the classification table means in said operating position, communicates with the open downstream end of said infeed table means to receive the inflow of the stream of water and said charge that passes over said first bottom wall and thence onto said separation plate along a primary path; said classification table means being further arrange to have, relative to said infeed table means, a collapsed position for carrying, where said classification table means and said infeed table means are positioned adjacent one another in general overlying relationship;

c. riffle means disposed transversely in a longitudinally spaced array beneath said separation plate and above said second bottom wall, said riffle means defining with said separation plate an upper flow channel intermediate said riffles and said separation plate through which water and particulate may pass along a secondary flow path and defining with said second bottom wall a lower mat channel intermediate said riffles and said second bottom wall for receiving a rentention mat; and, d. inlet channel means at a juncture of said infeed and classification table means, disposed at a height beneath said separation plate and beneath said first bottom wall of said infeed table means, and above said second bottom wall of said classification means, said inlet channel means extending substantially across the full transverse extent of said classification table and facing in an upstream direction to receive an inflow of water from said stream of water to flow directly to said secondary flow path.

2. The portable sluice box of claim 1, wherein said inlet channel means is defined within an upstanding partial front wall of said classification table means, located at the extreme upstream end of said second bottom wall.

3. The portable sluice box of claim 2, wherein said riffle means are comprised of a spaced array of angular riffle members having a first, top face disposed beneath a lower face of said separation plate lying generally parallel thereto to define said secondary flow path therebetween and downwardly extending front legs at upstream ends of said top faces to yield flow impediment means for the detritus passing through said separation plate.

4. The portable sluice box of claim 3, wherein said infeed table means and said classification table means are pivotally secured in a manner to be pivotally moved relative to one another between said operating position and said collapsed position.

5. The portable sluice box of claim 4, wherein said infeed table means is a generally trapezoidal table means having a tapering throat merging towards said classification table means and terminating at said separation plate.

6. The portable sluice box of claim 5, wherein said foraminous separation plate is comprised of a sheet of expanded metal, bent along opposed transverse edges to yield downwardly extending skirts and sized to be restrained within said classification table means with said skirts in frictional mating engagement with said second sidewalls of said classification table means.

7. The portable sluice box of claim 1, wherein said classification plate means is pivotally secured to said classification table means in a manner to be pivotally moved relative to one another between said operating position and said collapsed position.

8. The portable sluice box of claim 7, further comprising handle means for transporting said sluice box in a collapsed configuration and for securing said sluice box in a deployed configuration within said stream of water against movement.

9. A portable sluice box adapted to be carried conveniently to an operating location and to be positioned in a stream of water for classification of mineral particulate from detritus containing the same, said sluice box having a front upstream end, a rear downstream end, a longitudinal axis extending from said front end to said rear end, and a transverse axis, said box comprising:

a. infeed table means, including upstanding first sidewalls and a first bottom wall at a first level for receiving and confining a charge of mineral-containing detritus for fluid compelled movement along a path lying in a material handling plane generally coincident with said first bottom wall of said table means, said infeed table means having an open upstream end to receive an inflow of the stream of water over said first bottom wall and an open downstream end to discharge the charge under the influence of the moving stream;

b. a classification table means arranged to have, relative to said infeed table means, an operating position where said classification table means is secured to said infeed table means so as to extend therefrom in a downstream direction, said classification table means comprising two upstanding second sidewalls and a second bottom wall positioned at a second level below said first level, said classification table means having a foraminous separation plate which, with the classification table means in said operating position, is at a level above said second bottom wall but no higher than said first level and extending between said two second sidewalls, said classification table means having a substantially open upstream end which, with the classification table means in said operating position, communicates with the open downstream end of said infeed table means to receive the inflow of the stream of water and said charge that passes over said first bottom wall and thence onto said separation plate along a primary path; said classification table means being further arranged to have, relative to said infeed table means, a collapsed position for carrying, where said classification table means and said infeed table means are positioned adjacent one another in general overlying relationship;

c. riffle means disposed transversely in a longitudinally spaced array beneath said separation plate and above said second bottom wall, said riffle means defining with said separation plate an upper flow channel intermediate said riffles and said separation plate through which water and particulate may pass along a secondary flow path and defining with said second bottom wall a lower channel intermediate said riffles and said second bottom wall;

d. a retention mat positioned in said lower channel;

e. inlet channel means at a juncture of said infeed and classification table means, disposed at a height beneath said separation plate and beneath said first bottom wall of said infeed table means, and above said second bottom wall of said classification means, said inlet channel means extending substantially across the full transverse extent of said classification table and facing in an upstream direction to receive an inflow of water from said stream of water to flow directly to said secondary flow path.

10. The portable sluice box of claim 9, wherein said inlet channel means is defined within an upstanding partial front wall of said classification table means located at the extreme upstream end of said second bottom wall.

11. The portable sluice box of claim 10, wherein said riffle means are comprised of a spaced array on angular riffle members having a first, top face disposed beneath a lower face of said separation plate lying generally parallel thereto to define said secondary flow path therebetween and downwardly extending front legs at upstream ends of said top faces to yield flow impediment means for the detritus passing through said separation plate.

12. The portable sluice box of claim 11, wherein said infeed table means and said classification table means are pivotally secured in a manner to be pivotally moved relative to one another between said operating position and said collapsed position.

13. The portable sluice box of claim 12, wherein said infeed table means is a generally trapezoidal table means having a tapering throat merging toward said classification table means and terminating at said separation plate.

14. The portable sluice box of claim 13, wherein said foraminous separation plate is comprised of a sheet of expanded metal, bent along opposed transverse edges to yield downwardly extending skirts and sized to be restrained within said classification table means with said skirts in frictional mating engagement with said second sidewalls of said classification table means.

15. The portable sluice box of claim 9, wherein said classification plate means is pivotally secured to said classification table in a manner to be pivotally moved relative to one another between said operating position and said collapsed position.

16. The portable sluice box of claim 15, further comprising handle means for transporting said sluice box in a collapsed configuration and for securing said sluice box in a deployed configuration within said stream of water against movement.

* * * * *